US010047510B2

(12) United States Patent
Cummings et al.

(10) Patent No.: US 10,047,510 B2
(45) Date of Patent: Aug. 14, 2018

(54) RIMLESS TOILET PAN AND A METHOD OF FLUSHING SAME

(71) Applicant: Caroma Industries Limited, Eagle Farm, Queensland (AU)

(72) Inventors: Stephen John Cummings, East Mona Vale (AU); Leonard Conrad, Mona Vale (AU); Johann Karunaratne, Allamble Heights (AU); Frank Quartiero, Prestons (AU)

(73) Assignee: Caroma Industries Limited, Queensland (AU)

( * ) Notice: Subject to any disclaimer, the term of this patent is extended or adjusted under 35 U.S.C. 154(b) by 0 days.

(21) Appl. No.: 15/538,904

(22) PCT Filed: Jun. 2, 2016

(86) PCT No.: PCT/AU2016/000190
§ 371 (c)(1),
(2) Date: Jun. 22, 2017

(87) PCT Pub. No.: WO2017/049332
PCT Pub. Date: Mar. 30, 2017

(65) Prior Publication Data

US 2017/0370085 A1 Dec. 28, 2017

(30) Foreign Application Priority Data

Sep. 21, 2015 (AU) ..... 2015903842

(51) Int. Cl.
*E03D 1/00* (2006.01)
*E03D 11/08* (2006.01)
(Continued)

(52) U.S. Cl.
CPC ..... *E03D 11/08* (2013.01); *E03D 1/26* (2013.01); *E03D 11/13* (2013.01); *E03D 2201/30* (2013.01); *E03D 2201/40* (2013.01)

(58) Field of Classification Search
CPC ..... E03D 11/08; E03D 11/13; E03D 11/16; E03D 2201/30; E03D 2201/40
(Continued)

(56) References Cited

U.S. PATENT DOCUMENTS 1,142,249 A * 6/1915 Griffiths ..... E03D 11/13 4/420
5,566,401 A * 10/1996 Kishi ..... E03D 9/00 4/232

(Continued)

*Primary Examiner* — Huyen Le
(74) *Attorney, Agent, or Firm* — Wood, Phillips, Katz, Clark & Mortimer

(57) ABSTRACT

A rimless toilet pan (20) includes a forward end (F), a rearward end (R) and a pan bowl (28). A flushing outlet (32) is in fluid communication with the pan bowl (28). A flushing water inlet (30) is in fluid communication with the pan bowl (28). An inwardly facing first sidewall (34) extends substantially around the top of the pan bowl (28). A substantially horizontal ledge extends (36) substantially around the bottom of the first sidewall (34). An inwardly facing second sidewall (37) extends substantially around the pan bowl (28) under the horizontal ledge (36). A flushing water flow splitter (38) is substantially adjacent a rearward end of the first sidewall (34), the flow splitter (38) is in fluid communication with the flushing water inlet (30) and has a leftwards outlet (38*a*) and a rightwards outlet (38*b*). A flushing water flow balancer (40) is on a frontwards part of the first sidewall (34), the flow balancer (40) including an inwardly facing projection (40*a*, 40*b*, 40*c*) extending vertically through at least part of the height of the first sidewall (34) and being positioned substantially symmetrically in relation to a forward to rearward centerline of the toilet pan (20). The (Continued)

flow balancer (40) includes leftward (40*a*) and rightward (40*b*) angled surfaces which meet at an innermost edge (40*c*) that is substantially aligned with the forward to rearward centerline of the toilet pan (20). The leftward (40*a*) and rightward (40*b*) angled surfaces are substantially triangular in shape and taper from a relatively wide lower part to a narrowed or pointed upper part.

10 Claims, 8 Drawing Sheets

(51) Int. Cl.
*E03D 1/26* (2006.01)
*E03D 11/13* (2006.01)

(58) Field of Classification Search
USPC ..... 4/300
See application file for complete search history.

(56) References Cited

U.S. PATENT DOCUMENTS

2009/0293187 A1* 12/2009 Pessel ..... E03D 9/032 4/420
2010/0186158 A1* 7/2010 Morita ..... E03D 11/08 4/420
2013/0219605 A1* 8/2013 Grover ..... E03D 11/08 4/300.3

* cited by examiner

RIMLESS TOILET PAN AND A METHOD OF FLUSHING SAME

FIELD OF THE INVENTION

The present invention relates to a rimless toilet pan and a method of flushing same.

BACKGROUND OF THE INVENTION

International PCT application no. PCT/AU2015/000269 discloses a rimless toilet pan and an associated flushing method. More particularly, PCT/AU2015/000269 discloses a rimless toilet pan with a flushing water flow splitter and a flushing water flow balancer. The flow splitter is positioned at the rear of the pan and splits the flushing water into leftwards and rightwards streams. The flow balancer is positioned at the front of the pan and includes an inwardly facing projection.

The projection directs the leftward and rightward streams inwardly and away from the pan sidewall and causes them to combine in a concentrated flushing stream or jet, which is directed substantially rearwardly along the centreline of the pan and downwardly towards the lowermost part of the pan bowl. The main purpose of the water stream/jet is to clear the contents of the pan bowl into the pan outlet. The flow balancer advantageously effects this flushing action, by controlling the collision of the leftward and rightward flushing streams such that the likelihood of deviation from the centreline of the pan is minimized. As a result, the accuracy of the rearward and downward direction of the combined streams towards the pan bowl is maximised. Put another way, the flow balancer minimises the likelihood of the combined flushing stream/jet being directed at a side surface of the bowl, which would dissipate its flushing energy. This improves the waste clearance of the pan and allows adequate waste clearance of the pan to be maintained whilst reducing the volume of flushing water required.

OBJECT OF THE INVENTION

It is an object of the present invention to provide improvements and/or variations to the rimless toilet pan disclosed in PCT/AU2015/000269.

SUMMARY OF INVENTION

Accordingly, in a first aspect, the present invention provides a rimless toilet pan including:

a forward end;

a rearward end;

a pan bowl;

a flushing outlet in fluid communication with the pan bowl;

a flushing water inlet in fluid communication with the pan bowl;

an inwardly facing first sidewall extending substantially around the top of the pan bowl;

a substantially horizontal ledge extending substantially around the bottom of the first sidewall;

an inwardly facing second sidewall extending substantially around the pan bowl under the horizontal ledge;

a flushing water flow splitter substantially adjacent a rearward end of the first sidewall, the flow splitter in fluid communication with the flushing water inlet and having a leftwards outlet and a rightwards outlet; and a flushing water flow balancer on a frontwards part of the first sidewall, the flow balancer including an inwardly facing projection extending vertically through at least part of the height of the first sidewall and being positioned substantially symmetrically in relation to a forward to rearward centreline of the toilet pan, the flow balancer includes leftward and rightward angled surfaces which meet at an innermost edge that is substantially aligned with the forward to rearward centreline of the toilet pan, wherein the leftward and rightward angled surfaces are substantially triangular in shape and taper from a relatively wide lower part to a narrowed or pointed upper part.

The sidewall is defined between an upper edge and a lower edge and, at least in the region of the flushing water flow balancer, projects more inwardly along the upper edge and less inwardly along the lower edge.

In one form, the inner most edge of the flow balancer is a flat surface, preferably substantially vertical.

In a second aspect, the present invention provides a rimless toilet pan including:

a forward end;

a rearward end;

a pan bowl;

a flushing outlet in fluid communication with the pan bowl;

a flushing water inlet in fluid communication with the pan bowl;

an inwardly facing first sidewall extending substantially around the top of the pan bowl;

a substantially horizontal ledge extending substantially around the bottom of the first sidewall;

an inwardly facing second sidewall extending substantially around the pan bowl under the horizontal ledge;

a flushing water flow splitter substantially adjacent a rearward end of the first sidewall, the flow splitter in fluid communication with the flushing water inlet and having a leftwards outlet and a rightwards outlet;

a left flushing water flow balancer on a frontwards part of the first sidewall, the left flow balancer including an inwardly facing projection extending vertically through at least part of the height of the first sidewall and leftward and rightward angled surfaces which meet at an innermost edge; and a right flushing water flow balancer on a frontwards part of the first sidewall, the right flow balancer including an inwardly facing projection extending vertically through at least part of the height of the first sidewall and leftward and rightward angled surfaces which meet at an innermost edge, wherein the left and right flow balancers are positioned substantially symmetrically with respect to each other on either side of a forward to rearward centreline of the pan.

The leftward and rightward angled surfaces of each of the flow balancers are preferably substantially triangular in shape and taper from a relatively wide lower part to a narrowed or pointed upper part.

In a third aspect, the present invention provides a method of flushing a rimless toilet pan, the method including:

directing flushing water from an inlet to a flow splitter having a leftward and a rightwards outlet;

directing the water from each of the leftwards and the rightwards outlets along left and right inner sidewalls of the toilet pan as a left stream and a right stream respectively;

passing the left stream over a left flow balancer projection extending through at least part of the left side wall, to direct the left stream inwardly and away from the left inner sidewall; and passing the right stream over a right flow balancer projection extending through at least part of the right side wall, to direct the right stream inwardly and away from the right inner sidewall, wherein the inwardly directed left stream and right stream merge and form a combined stream or jet.

The left and right flow balancers are positioned substantially symmetrically with respect to each other on either side of a forward to rearward centreline of the pan.

BRIEF DESCRIPTION OF DRAWINGS

Preferred embodiments of the invention will now be described, by way of examples only, with reference to the accompanying drawings in which.

DETAILED DESCRIPTION OF PREFERRED EMBODIMENTS

Figure 1:
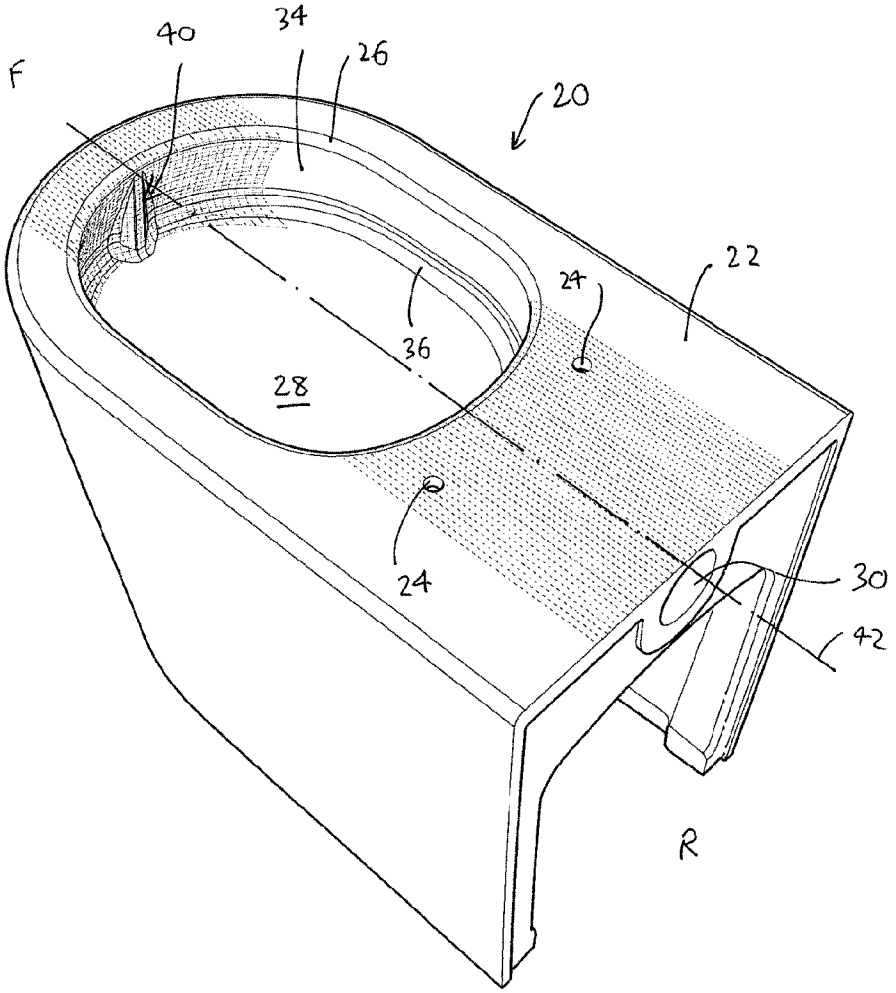
FIG. 1 is a rear perspective view of a first embodiment of a rimless toilet pan.
Figure 2:
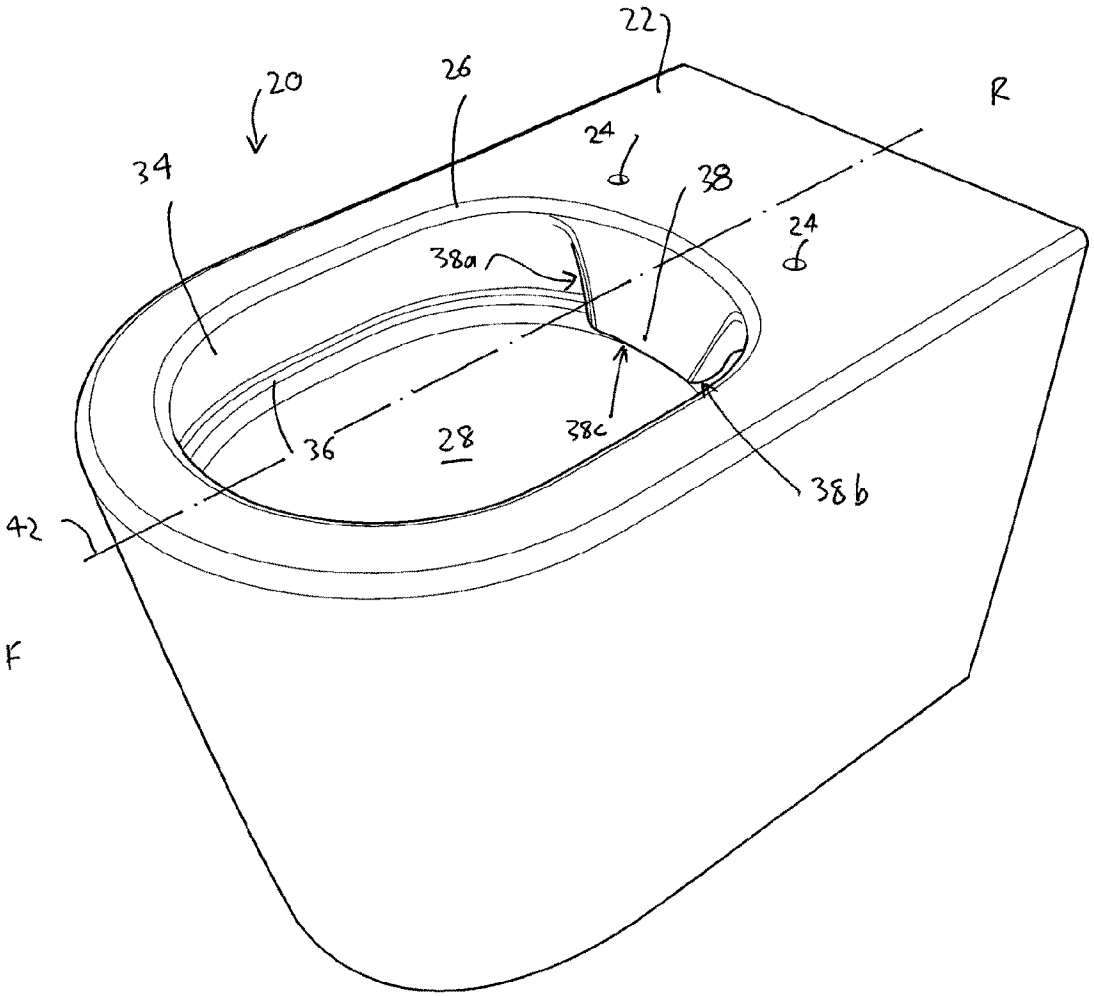
FIG. 2 is a front perspective view of the pan shown in FIG. 1.

FIGS. 1 and 2 show a first embodiment of a rimless toilet pan 20. The pan 20 is produced from vitreous china but can alternatively be made from plastic or other sanitary ware-suitable materials. The pan 20 has a forward end F and a rearward end R. The pan 20 has a top surface 22 with a pair of holes 24, which are used to fasten a seat and lid (not shown) thereto. The top 22 also includes an opening bounded by an upper peripheral edge 26 which leads to a pan bowl 28.

A flushing water inlet 30 is located at the rear end R of the pan 20. The flushing water inlet 30 is connected to the outlet of a toilet cistern (not shown) as is well understood by person skilled in the art. In the United States, a cistern is commonly referred to as a flushing tank.

Figure 4:
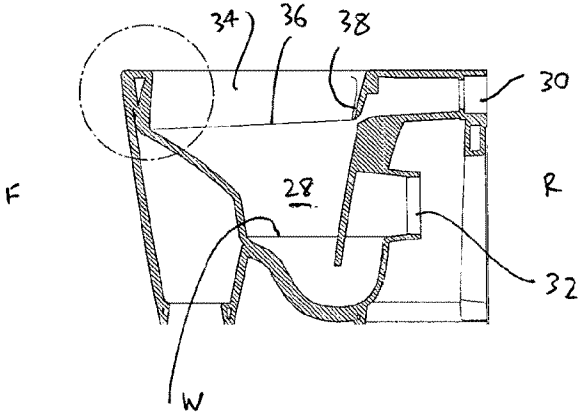
FIG. 4 is a cross sectional side view of the pan shown in FIG. 1.
Figures 6, 7, 8, 9, 10, 11:
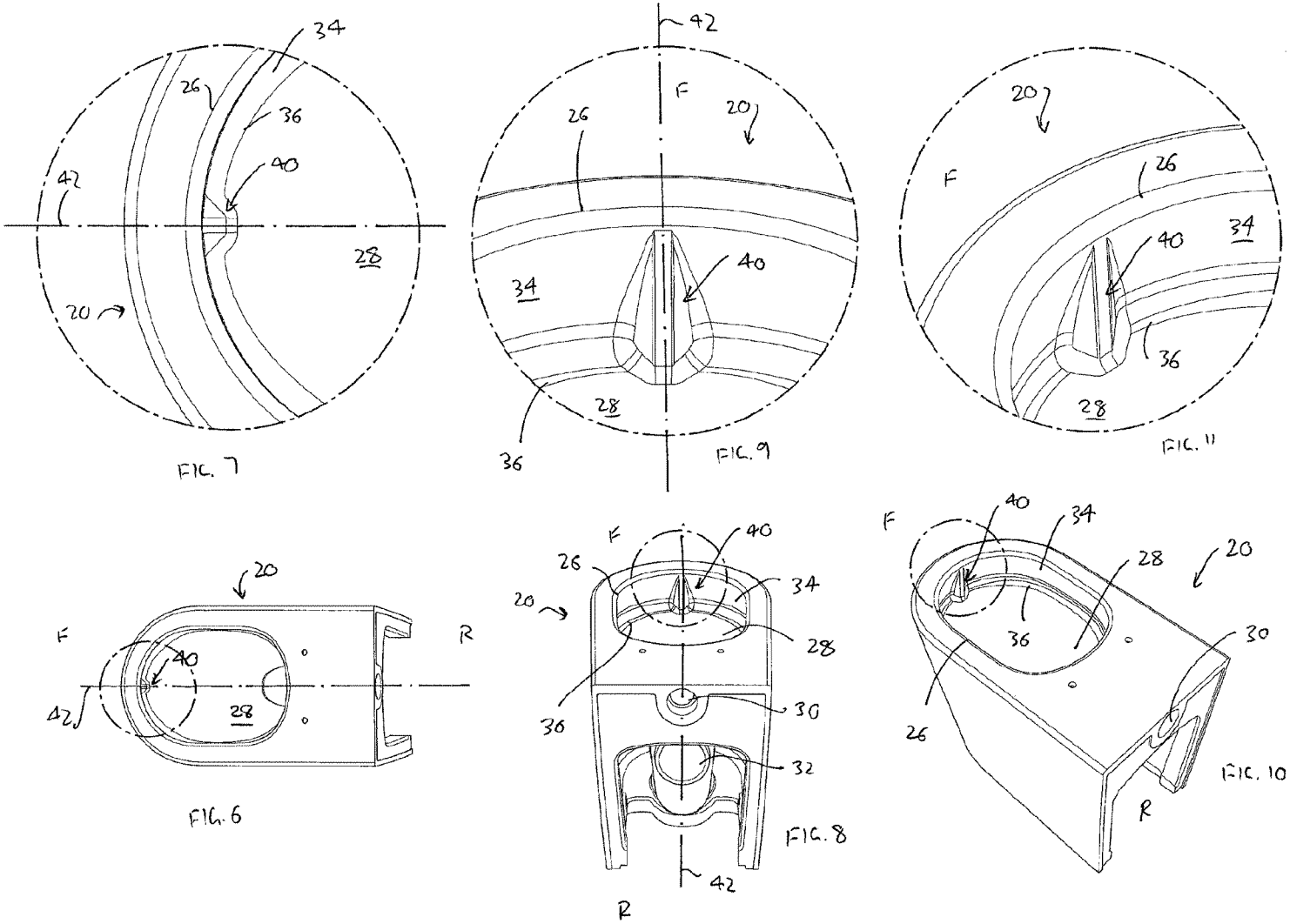
FIG. 6 is a top view of the pan shown in FIG. 1.
FIG. 7 is an enlarged partial detail view of the pan shown in FIG. 5.
FIG. 8 is a rear view of the pan shown in FIG. 1.
FIG. 9 is an enlarged partial detail view of the pan shown in FIG. 7.
FIG. 10 is a perspective view of the pan shown in FIG. 1.
FIG. 11 is an enlarged partial detail view of the pan shown in FIG. 9.

As best seen in FIG. 4, the pan 20 also includes a flushing outlet 32 which is connectable to a mains sewer, as is well understood by person skilled in the art. FIG. 4 (and also FIG. 12) shows the pan's trap water level W before flushing.

The pan 20 includes an inwardly facing first sidewall 34, which extends substantially around the top of the pan bowl 28 up to the upper peripheral edge 26. The pan 20 also includes a substantially horizontal ledge 36, which extends substantially around the bottom of the first sidewall 34. The ledge 36 also defines a lower peripheral edge of the first sidewall 34. An inwardly facing second sidewall 37 extends substantially around the pan bowl 28 under the ledge 36.

Figure 3:
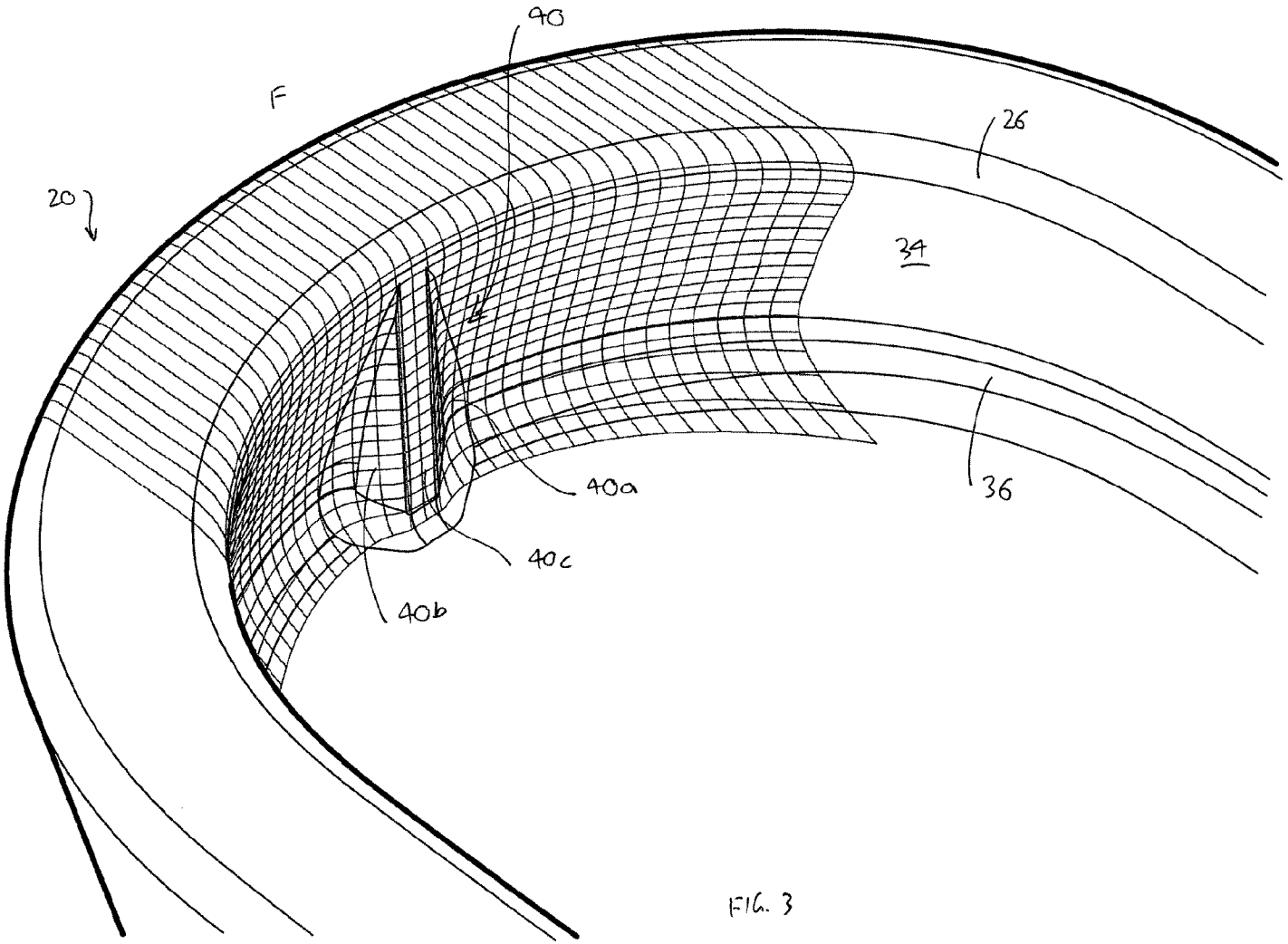
FIG. 3 is an enlarged partial detail rear perspective view of the pan shown in FIG. 1.
Figure 5:
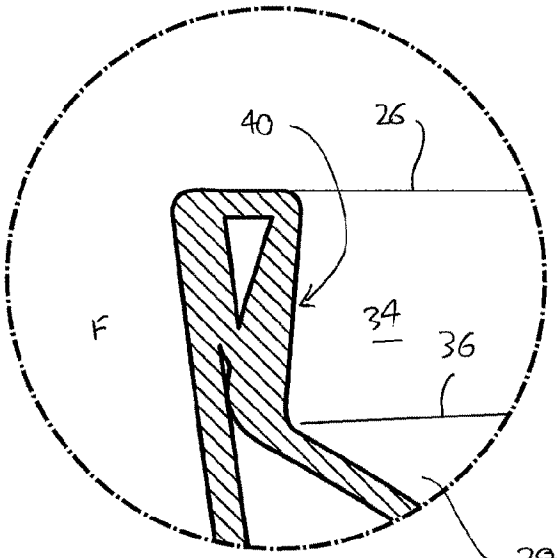
FIG. 5 is an enlarged partial detail view of the pan shown in FIG. 3.
Figure 13:
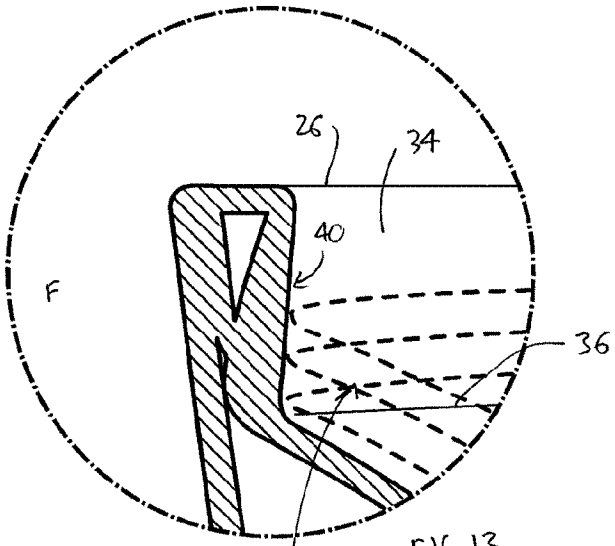
FIG. 13 is a first enlarged partial detail of the pan shown in FIG. 12 during flushing.

As best seen in FIGS. 2 and 3, the pan 20 also includes a flushing water flow splitter 38 which is in fluid communication with the flushing water inlet 30. The flow splitter 38 includes a leftwards outlet 38*a* and a rightwards outlet 38*b*. When viewed from above, and with reference to 12 o'clock (front F) and 6 o'clock (rear R) being aligned on the centreline 42, the leftwards outlet 38*a* and the rightwards outlet 38*b* are positioned around the sidewall at about 5 o'clock and 7 o'clock respectively. The flow splitter 38 also includes a downwards and inwards directed bottom outlet 38*c*, as best shown in FIG. 13. The bottom outlet 38*c* is in the form of a gap between the bottom edge of the flow splitter 38 and the adjacent rear wall of the pan bowl 28.

As best shown in FIG. 3, the pan 20 includes a flushing water flow balancer, indicated generally by the reference numeral 40, on a frontwards part of the first sidewall 34. The flow balancer 40 includes an inwardly facing projection (see items 40*a*, 40*b*, 40*c* described below) extending vertically through most of the height of the first sidewall 34. The flow balancer 40 is positioned substantially symmetrically in relation to a forward to rearward centreline 42 of the pan 20 (see FIGS. 5 and 6 and FIGS. 7 and 8). The flow balancer 40 includes leftward and rightward inwardly angled surfaces 40*a* and 40*b*, which meet along an innermost edge 40*c* that is substantially aligned with the centreline 42 of the pan 20. The edge 40*c* is in the form of a substantially vertical flat surface. The surfaces 40*a* and 40*b* are slightly outwardly concave, are substantially triangular in shape and taper from a relatively wide lower part to a narrowed or pointed upper part. The tapering is caused by the inner sidewall 44 projecting more inwardly near its top, near the upper edge 26, and less inwardly near its bottom, near the lower edge defined by the ledge 36. The ledge 36 also follows the shape of the projection 40 in a region 36*a* adjacent to the flow balancer 40. The sidewall 34 has a downward outward slope. When viewed from above, the flow balancer 40 has a generally triangular cross section, with a truncated edge/surface 40*c*.

The operation of the toilet pan 20 shall now be described.

Figure 12:
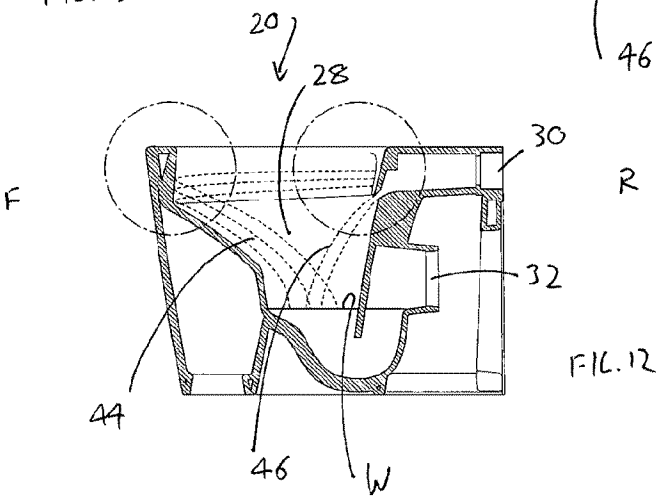
FIG. 12 is a cross sectional side view of the pan shown in FIG. 1 during flushing.

Referring now to FIG. 12, when a user actuates the cistern to cause flushing of the toilet pan 20, flushing water is communicated from the cistern to the flushing water inlet 30. The flushing water then travels from the inlet 30 to the flow splitter 38, where it is split into leftward and rightward streams. As best shown in FIG. 13, a majority of the leftward and rightward streams flow along and around the first sidewall 34 towards the flow balancer 40. The leftward and rightward angled surfaces 40*a* and 40*b* respectively direct the leftward and rightward streams inwardly and away from the sidewall 34 and cause them to combine in a concentrated flushing stream or jet 44, which is directed substantially rearwardly along the centreline 42 of the pan 20 and downwardly towards the lowermost part of the pan bowl 28. The main purpose of the water stream/jet 44 is to clear the contents of the pan bowl 28 into the pan outlet 32. The flow balancer 40 advantageously effects this flushing action, by controlling the collision of the leftward and rightward flushing streams such that the likelihood of deviation from the centreline 42 of the pan 20 is minimized. As a result, the accuracy of the rearward and downward direction of the combined streams towards the pan bowl 28 is maximised. Put another way, the flow balancer 40 minimises the likelihood of the combined flushing stream/jet being directed at a side surface of the bowl 28, which would dissipate its flushing energy. This improves the waste clearance of the pan 20 and allows adequate waste clearance of the pan 20 to be maintained whilst reducing the volume of flushing water required. The reduction of water usage has a cost and an environmental benefit. Further, a small proportion of the leftward and rightward streams spills over the ledge 36 and flows down into the pan bowl 28.

The triangular shape of the surface 40*a* and 40*b*, and the downward outward slope of the sidewall 44, causes the flushing water to converge into stream 44 in a controlled manner, and be optimally directed onto the waste water surface W in the base of the bowl 28.

Figure 14:
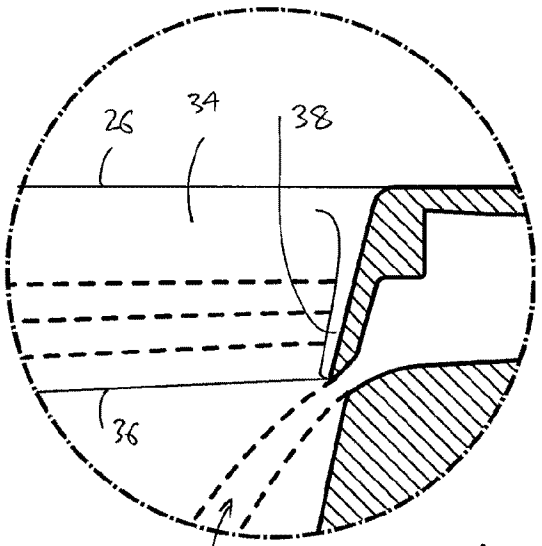
FIG. 14 is a second enlarged partial detail view of the pan shown in FIG. 12 during flushing.

As best shown in FIG. 14, a minority of the flushing water exits the flow splitter 38 via the bottom outlet 38*c*, in the form of stream 46. The main purpose of the water stream 46 is to clean the rearward wall surface of the pan bowl 28 and to help push the waste down into the main flushing water stream. In relation to the latter, the water stream 46 reaches the water W and waste before the water stream 44, as the water stream 44 takes longer to travel around the sidewall 34 before being directed into the pan bowl 28. As a result, the stream 46 pushes down and compresses the waste (e.g. toilet paper) before the stream 44 forces the waste through to the outlet 32. This also improves the waste clearance of the pan 20, particularly with reduced (e.g. less than 4 liter) flushing water volumes.

Figure 15:
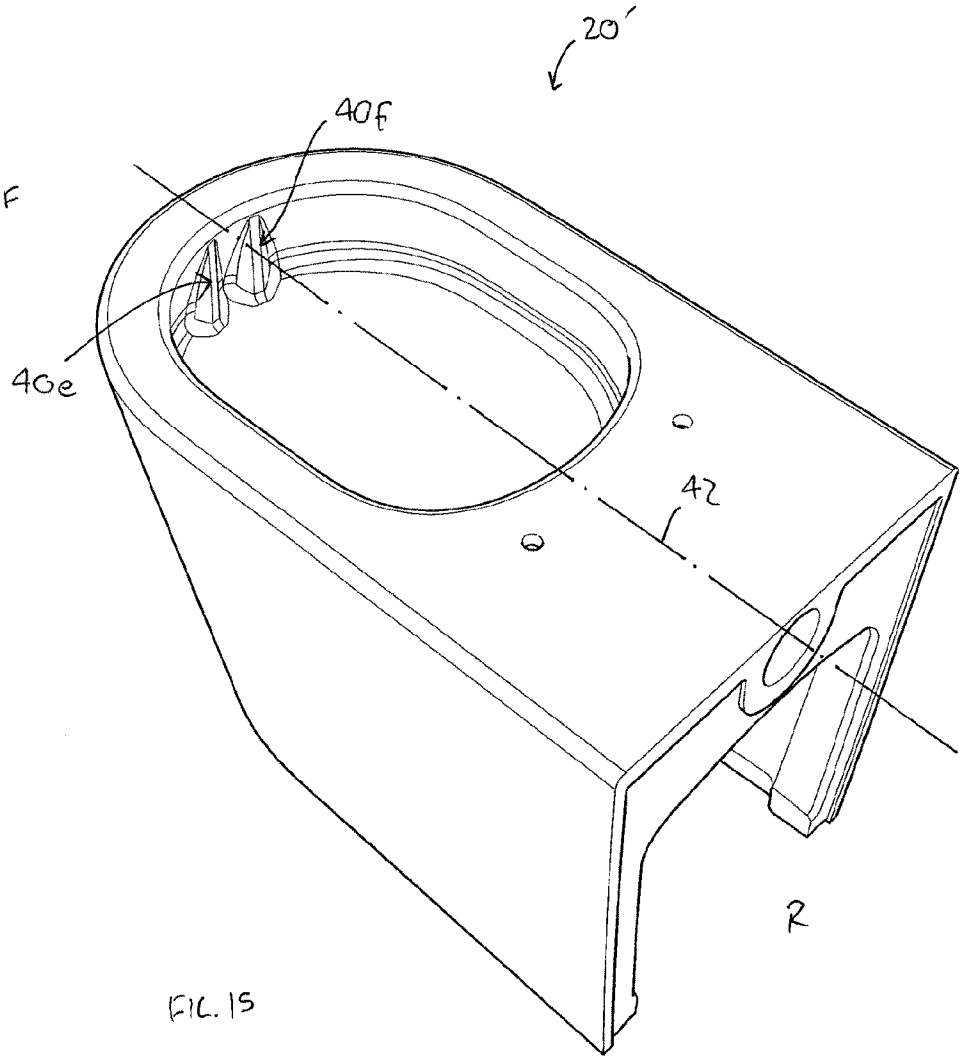
FIG. 15 is a rear perspective view of a second embodiment of a rimless toilet pan.

FIG. 15 shows a second embodiment of a rimless toilet pan 20'. The pan 20' is similar in construction and operation to the pan 20 and like features have been indicated with like reference numerals. However, the pan 20' includes a left flushing water flow balancer 40*e* and a right flushing water flow balancer 40*f* that are positioned substantially symmetrically with respect to each other on either side of the pan centreline 42 about 11 o'clock and 1 o'clock respectively.

Figure 16:
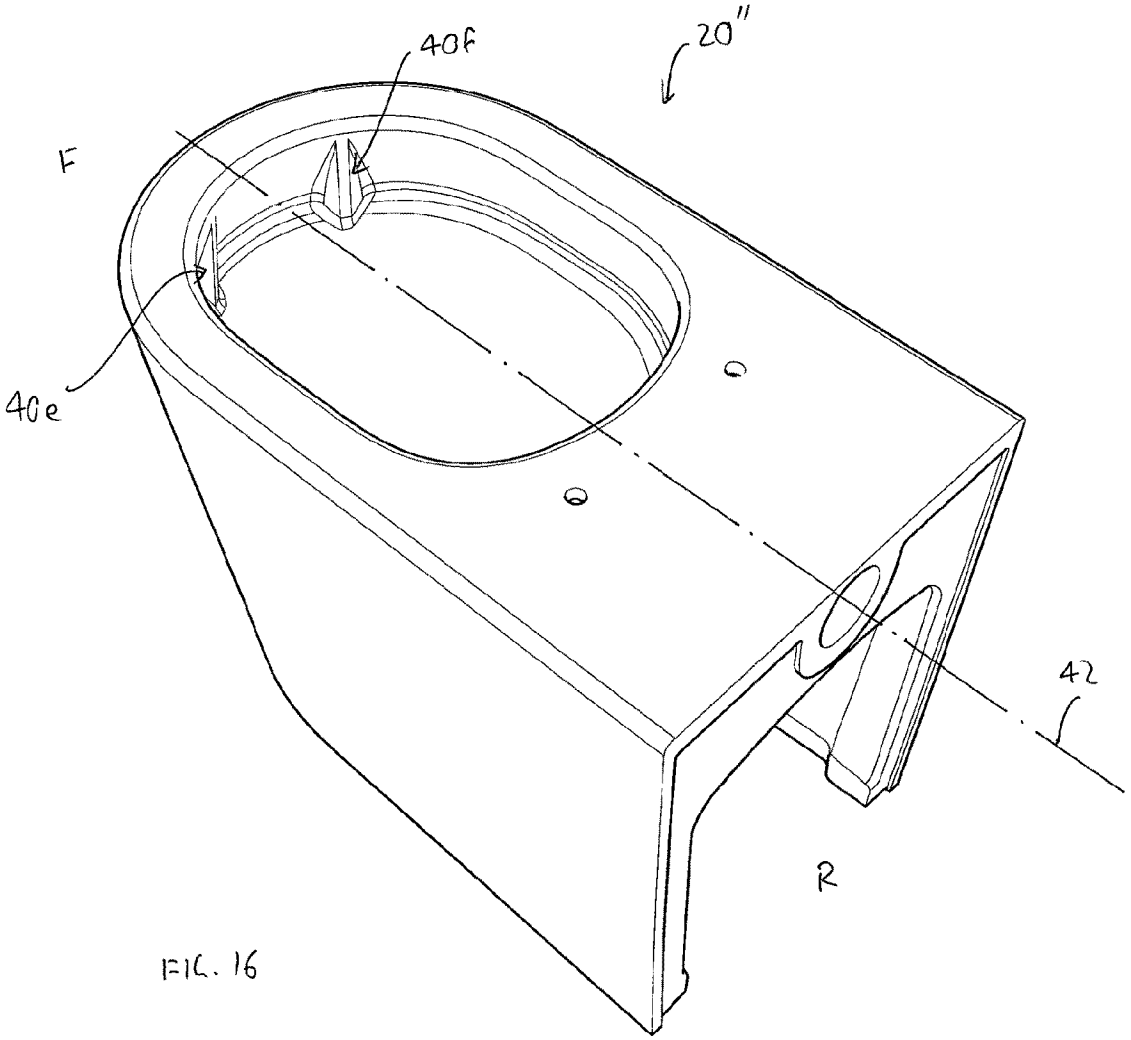
FIG. 16 is a rear perspective view of a third embodiment of a rimless toilet pan.

FIG. 16 shows a second embodiment of a rimless toilet pan 20". The pan 20" is similar in construction and operation to the pan 20' and like features have been indicated with like reference numerals. The pan 20" also includes left and right flushing water flow balancers 40*e* and 40*f*, symmetrically positioned on either side of the pan centreline 42 at about 10 o'clock and 2 o'clock respectively.

The left and right flushing water flow balancers 40*e* and 40*f* cause the flushing water to converge into one stream 44 in a controlled manner, and target the waste water surface W in the base of the bowl 28.

Although the invention has been described with reference to preferred embodiments, it will be appreciated by person skilled in the art that the invention may be embodied in many other forms.

The invention claimed is:

1. A rimless toilet pan including:

a forward end;

a rearward end;

a pan bowl;

a flushing outlet in fluid communication with the pan bowl;

a flushing water inlet in fluid communication with the pan bowl;

an inwardly facing first sidewall extending substantially around the top of the pan bowl;

a substantially horizontal ledge extending substantially around the bottom of the first sidewall;

an inwardly facing second sidewall extending substantially around the pan bowl under the horizontal ledge;

a flushing water flow splitter substantially adjacent a rearward end of the first sidewall, the flow splitter in fluid communication with the flushing water inlet and having a leftwards outlet and a rightwards outlet; and a flushing water flow balancer on a frontwards part of the first sidewall, the flow balancer including an inwardly facing projection extending vertically through at least part of the height of the first sidewall and being positioned substantially symmetrically in relation to a forward to rearward centreline of the toilet pan, the flow balancer includes leftward and rightward angled surfaces which meet at an innermost edge that is substantially aligned with the forward to rearward centreline of the toilet pan, wherein the leftward and rightward angled surfaces are substantially triangular in shape and taper from a relatively wide lower part to a narrowed or pointed upper part.

2. The rimless toilet pan as claimed in claim 1, wherein the sidewall is defined between an upper edge and a lower edge and, at least in the region of the flushing water flow balancer, projects more inwardly along the upper edge and less inwardly along the lower edge.

3. The rimless toilet pan as claimed in claim 2, wherein the inner most edge of the flow balancer is a flat surface.

4. The rimless toilet pan as claimed in claim 2, wherein the inner most edge of the flow balancer is a substantially vertical flat surface.

5. The rimless toilet pan as claimed in claim 1, wherein the inner most edge of the flow balancer is a flat surface.

6. The rimless toilet pan as claimed in claim 1, wherein the inner most edge of the flow balancer is a substantially vertical flat surface.

7. A rimless toilet pan including:

a forward end;

a rearward end;

a pan bowl;

a flushing outlet in fluid communication with the pan bowl;

a flushing water inlet in fluid communication with the pan bowl;

an inwardly facing first sidewall extending substantially around the top of the pan bowl;

a substantially horizontal ledge extending substantially around the bottom of the first sidewall;

an inwardly facing second sidewall extending substantially around the pan bowl under horizontal ledge;

a flushing water flow splitter substantially adjacent a rearward end of the first sidewall, the flow splitter in fluid communication with the flushing water inlet and having a leftwards outlet and a rightwards outlet;

a left flushing water flow balancer on a frontwards part of the first sidewall, the left flow balancer including an inwardly facing projection extending vertically through at least part of the height of the first sidewall and leftward and rightward angled surfaces which meet at an innermost edge; and a right flushing water flow balancer on a frontwards part of the first sidewall, the right flow balancer including an inwardly facing projection extending vertically through at least part of the height of the first sidewall and leftward and rightward angled surfaces which meet at an innermost edge, wherein the left and right flow balancers are positioned substantially symmetrically with respect to each other on either side of a forward to rearward centreline of the pan.

8. The rimless toilet pan as claimed in claim 7, wherein the leftward and rightward angled surfaces of each of the flow balancers are substantially triangular in shape and taper from a relatively wide lower part to a narrowed or pointed upper part.

9. A method of flushing a rimless toilet pan, the method including:

directing flushing water from an inlet to a flow splitter having a leftward and a rightwards outlet;

directing the water from each of the leftwards and the rightwards outlets along left and right inner sidewalls of the toilet pan as a left stream and a right stream respectively;

passing the left stream over a left flow balancer projection extending through at least part of the left side wall, to direct the left stream inwardly and away from the left inner sidewall; and passing the right stream over a right flow balancer projection extending through at least part of the right side wall, to direct the right stream inwardly and away from the right inner sidewall, wherein the inwardly directed left stream and right stream merge and form a combined stream or jet.

10. The method of flushing as claimed in claim 9, wherein the left and right flow balancers are positioned substantially symmetrically with respect to each other on either side of a forward to rearward centreline of the pan.

* * * * *